US011600239B2

(12) United States Patent
Hai

(10) Patent No.: US 11,600,239 B2
(45) Date of Patent: Mar. 7, 2023

(54) METHOD OF CONTROLLING DISPLAY PANEL, DISPLAY PANEL, AND DISPLAY DEVICE

(71) Applicant: TCL CHINA STAR OPTOELECTRONICS TECHNOLOGY CO., LTD., Guangdong (CN)

(72) Inventor: Bo Hai, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 18 days.

(21) Appl. No.: 16/972,612

(22) PCT Filed: Oct. 23, 2020

(86) PCT No.: PCT/CN2020/123221
§ 371 (c)(1),
(2) Date: Dec. 7, 2020

(87) PCT Pub. No.: WO2022/047930
PCT Pub. Date: Mar. 10, 2022

(65) Prior Publication Data

US 2022/0189424 A1 Jun. 16, 2022

(30) Foreign Application Priority Data

Sep. 3, 2020 (CN) ..... 202010913117.4

(51) Int. Cl.
*G09G 3/36* (2006.01)

(52) U.S. Cl.
CPC ..... *G09G 3/36* (2013.01); *G09G 2320/0252* (2013.01)

(58) Field of Classification Search
CPC ... G09G 2320/0261; G09G 2320/0252; G09G 2320/0257; G09G 3/36; G09G 2320/106; G09G 2340/16
See application file for complete search history.

(56) References Cited

U.S. PATENT DOCUMENTS 7,205,970 B2 * 4/2007 Kim ..... G09G 3/3629 345/95
7,248,241 B2 * 7/2007 Chen ..... G09G 3/3611 345/89

(Continued)

FOREIGN PATENT DOCUMENTS

CN 101197122 A 6/2008
CN 101212606 A 7/2008

(Continued)

*Primary Examiner* — Michael J Jansen, II
(74) *Attorney, Agent, or Firm* — PV IP PC; Wei Te Chung; Ude Lu

(57) ABSTRACT

A method of controlling a display panel, a display panel, and a display device are disclosed. The display panel includes a display panel for image displays. The method of controlling the display panel includes obtaining a target grayscale area in the display area, and driving grayscales of the target grayscale area based on a desired voltage. The desired voltage is obtained by at least two times of adjustments according to historical display data of the target grayscale area. The present application is provided to improve display effects of the display panel.

13 Claims, 7 Drawing Sheets

(56) References Cited

U.S. PATENT DOCUMENTS 7,358,947 B2 * 4/2008 Lee ..... G09G 3/2011 345/89
7,777,765 B2 * 8/2010 Adachi ..... G09G 3/3648 345/690
7,956,876 B2 * 6/2011 Shiomi ..... G09G 3/3648 345/87
8,159,434 B2 * 4/2012 Kimura ..... G09G 3/2011 345/94
8,164,554 B2 * 4/2012 Takaki ..... G09G 3/2022 345/89
8,699,803 B2 * 4/2014 Katayama ..... G09G 3/3648 382/250
8,749,597 B2 * 6/2014 Hung ..... G09G 3/3611 345/691
8,970,638 B2 * 3/2015 Kimura ..... G06T 1/00 345/698
9,123,132 B2 * 9/2015 Tamura ..... G06T 5/008
10,269,286 B2 * 4/2019 Zhang ..... G09G 3/2074
10,978,010 B2 * 4/2021 Chang ..... G09G 3/3607
10,997,898 B2 * 5/2021 Wang ..... G09G 3/3291
11,158,276 B1 * 10/2021 Xiao ..... G09G 3/3677
11,205,368 B2 * 12/2021 Kim ..... G09G 3/2007
2003/0058211 A1 * 3/2003 Kim ..... G09G 3/3629 345/89
2004/0027322 A1 * 2/2004 Chen ..... G09G 3/3611 345/89
2004/0130559 A1 * 7/2004 Lee ..... G09G 3/2011 345/690
2005/0200619 A1 * 9/2005 Adachi ..... G09G 3/3648 345/204
2007/0035510 A1 * 2/2007 Zhou ..... G09G 3/344 345/107
2007/0216624 A1 * 9/2007 Kimura ..... G09G 3/3648 345/89
2008/0129762 A1 * 6/2008 Shiomi ..... G09G 3/3648 345/690
2009/0010339 A1 1/2009 Hsu et al.
2009/0136158 A1 * 5/2009 Tamura ..... H04N 5/44 382/293
2009/0147029 A1 * 6/2009 Hung ..... G09G 3/3611 345/690
2009/0267881 A1 * 10/2009 Takaki ..... G09G 3/3648 345/89
2010/0201719 A1 * 8/2010 Kimura ..... G06T 3/4053 345/698
2011/0206290 A1 * 8/2011 Katayama ..... H04N 19/60 382/250
2017/0278448 A1 * 9/2017 Zhang ..... G09G 3/2074
2020/0402446 A1 * 12/2020 Wang ..... G09G 3/3208
2021/0035513 A1 * 2/2021 Chang ..... G09G 3/3607
2021/0233456 A1 * 7/2021 Kim ..... G09G 3/2007
2021/0335307 A1 * 10/2021 Xiao ..... G09G 3/3688

FOREIGN PATENT DOCUMENTS

CN 102024403 A 4/2011
CN 102842297 A 12/2012
CN 105336298 A 2/2016
CN 106997582 A 8/2017

* cited by examiner

METHOD OF CONTROLLING DISPLAY PANEL, DISPLAY PANEL, AND DISPLAY DEVICE

BACKGROUND OF INVENTION

1. Field of Invention

The present invention relates to a technical field of displays, and particularly to, a method of controlling a display panel, a display panel, and a display device.

2. Related Art

With the popularity of liquid crystal display devices, performance requirements for liquid crystal display devices are gradually increasing. However, liquid crystal molecules in the liquid crystal display devices cannot reach required grayscale brightness immediately within one frame time under the driving of signal voltages of data lines, resulting in poor display effect of the liquid crystal display devices.

SUMMARY OF INVENTION

An embodiment of the present invention provides a method of controlling a display panel. The method includes obtaining a target grayscale area in the display area; driving grayscales of the target grayscale area based on a desired voltage, wherein the desired voltage is obtained by at least two times of adjustments according to historical display data of the target grayscale area.

In one embodiment of the present application, the driving the grayscales of the target grayscale area based on the desired voltage, wherein the desired voltage is obtained by at least two times of adjustments according to the historical display data of the target grayscale area includes driving the grayscales of the target grayscale area using an initial voltage to enable the target grayscale area to display a first preset image; enabling the first preset image to satisfy a first predetermined requirement by adjusting the initial voltage, so that the target grayscale area display a second preset image, and obtaining a driving voltage of each of the grayscales of the target grayscale area after a first adjustment process, so that a first driving voltage is obtained; enabling the second preset image to satisfy a second predetermined requirement by adjusting the first driving voltage of all the grayscales or some of the grayscales of the target grayscale area, and obtaining a driving voltage of each of the grayscales of the target grayscale area after a second adjustment process; and obtaining the desired voltage according to the driving voltage of each of the grayscales of the target grayscale area after the second adjustment process.

In one embodiment of the present application, the obtaining the desired voltage according to the driving voltage of each of the grayscales of the target grayscale area after the second adjustment process includes obtaining a plurality of second driving voltages by gaining the driving voltage of each of the grayscales of the target grayscale area after the second adjustment process; and calculating an average value of the plurality of second driving voltages to obtain the desired voltage.

In one embodiment of the present application, prior to the obtaining the target grayscale area in the display area, the method further includes using the display panel to play a preset video, and capturing a trailing picture in the preset video; and determining the target grayscale area according to the trailing picture.

In one embodiment of the present application, the determining the target grayscale area according to the trailing picture includes obtaining a grayscale value of a first preset position of the trailing picture and a grayscale value of a second preset position of the trailing picture; determining a moving direction of the trailing picture transitioning to a frame following the trailing picture according to the trailing picture and the frame following the trailing picture; and determining the target grayscale area based on the moving direction, the grayscale value of the first preset position, and the grayscale value of the second preset position.

In one embodiment of the present application, the moving direction includes a direction from a higher grayscale value to a lower grayscale vale, and a direction from a lower grayscale value to a higher grayscale value.

In one embodiment of the present application, the display area comprises a plurality of the grayscales arranged in an array.

An embodiment of the present invention further provides a display panel, including the grayscales of the target grayscale area of the display panel driven by the aforementioned desired voltage for improving image quality of a picture in the target grayscale area.

An embodiment of the present invention further provides a display device, including a display panel including a display area for image displays; and a processor electrically connected to the display panel and configured to obtain a target grayscale area in the display area and to drive grayscales of the target grayscale area based on a desired voltage, wherein the desired voltage is obtained by at least two times of adjustments according to historical display data of the target grayscale area.

In one embodiment of the present application, the processor is further configured to drive the grayscales of the target grayscale area using an initial voltage to enable the target grayscale area to display a first preset image; enable the first preset image to satisfy a first predetermined requirement by adjusting the initial voltage, so that the target grayscale area display a second preset image, and obtain a driving voltage of each of the grayscales of the target grayscale area after a first adjustment process, so that a first driving voltage is obtained; and enable the second preset image to satisfy a second predetermined requirement by adjusting the first driving voltage of all the grayscales or some of the grayscales of the target grayscale area, and obtain a driving voltage of each of the grayscales of the target grayscale area after a second adjustment process; and obtain the desired voltage according to the driving voltage of each of the grayscales of the target grayscale area after the second adjustment process.

In one embodiment of the present application, the processor is further configured to obtain a plurality of second driving voltages by obtaining the driving voltage of each of the grayscales of the target grayscale area after the second adjustment process, and calculating an average value of the plurality of second driving voltages to obtain the desired voltage.

In one embodiment of the present application, the processor is further configured to capture a trailing picture in a preset video using the display panel to play the preset video prior to obtaining the target grayscale area in the display area, and to determine the target grayscale area according to the trailing picture.

In one embodiment of the present application, the processor is further configured to obtain a grayscale value of a first preset position of the trailing picture and a grayscale value of a second preset position of the trailing picture, determine a moving direction of the trailing picture transitioning to a frame following the trailing picture according to the trailing picture and the frame following the trailing picture, and determine the target grayscale area based on the moving direction, the grayscale value of the first preset position, and the grayscale value of the second preset position.

In one embodiment of the present application, the moving direction comprises a direction from a higher grayscale value to a lower grayscale vale, and a direction from a lower grayscale value to a higher grayscale value.

In one embodiment of the present application, the display area comprises a plurality of the grayscales arranged in an array.

The method of controlling the display panel provided by the embodiments of the present invention can obtain a desired voltage after at least two optimization adjustments according to a trailing picture in a target grayscale area, and use the desired voltage to drive grayscales of the target grayscale area, thereby improving response times of the grayscales in the target grayscale area, remedying a defect of occurrence of trailing dynamic pictures, and improving display effects of the display panel.

DESCRIPTION OF PREFERRED EMBODIMENTS

Figure 1:
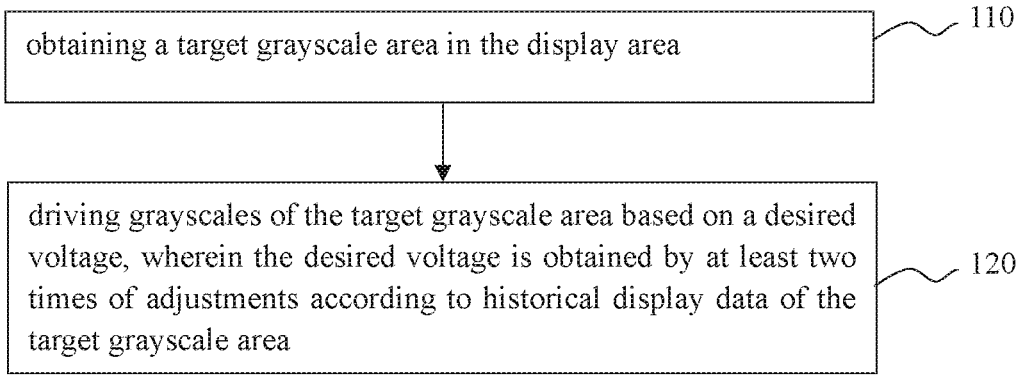
FIG. 1 is a first flowchart of a method of controlling a display panel in accordance with an embodiment of the present application.

The technical solutions in the embodiments of the present application will be clearly and completely described below in conjunction with the drawings in the embodiments of the present application. Obviously, the described embodiments are only a part of the embodiments of the present application, rather than all the embodiments. Based on the embodiments in this application, all other embodiments obtained by those skilled in the art without creative work are within the protection scope of this application An embodiment of the present application provides a method of controlling a display panel. The method includes obtaining a target grayscale area in the display area; driving grayscales of the target grayscale area based on a desired voltage, wherein the desired voltage is obtained by at least two times of adjustments according to historical display data of the target grayscale area.

In one embodiment of the present application, the driving the grayscales of the target grayscale area based on the desired voltage, wherein the desired voltage is obtained by at least two times of adjustments according to the historical display data of the target grayscale area includes driving the grayscales of the target grayscale area using an initial voltage to enable the target grayscale area to display a first preset image; enabling the first preset image to satisfy a first predetermined requirement by adjusting the initial voltage, so that the target grayscale area display a second preset image, and obtaining a driving voltage of each of the grayscales of the target grayscale area after a first adjustment process, so that a first driving voltage is obtained; enabling the second preset image to satisfy a second predetermined requirement by adjusting the first driving voltage of all the grayscales or some of the grayscales of the target grayscale area, and obtaining a driving voltage of each of the grayscales of the target grayscale area after a second adjustment process; and obtaining the desired voltage according to the driving voltage of each of the grayscales of the target grayscale area after the second adjustment process.

In one embodiment of the present application, the obtaining the desired voltage according to the driving voltage of each of the grayscales of the target grayscale area after the second adjustment process includes obtaining a plurality of second driving voltages by gaining the driving voltage of each of the grayscales of the target grayscale area after the second adjustment process; and calculating an average value of the plurality of second driving voltages to obtain the desired voltage.

In one embodiment of the present application, prior to the obtaining the target grayscale area in the display area, the method further includes using the display panel to play a preset video, and capturing a trailing picture in the preset video; and determining the target grayscale area according to the trailing picture.

In one embodiment of the present application, the determining the target grayscale area according to the trailing picture includes obtaining a grayscale value of a first preset position of the trailing picture and a grayscale value of a second preset position of the trailing picture; determining a moving direction of the trailing picture transitioning to a frame following the trailing picture according to the trailing picture and the frame following the trailing picture; and determining the target grayscale area based on the moving direction, the grayscale value of the first preset position, and the grayscale value of the second preset position.

In one embodiment of the present application, the moving direction includes a direction from a higher grayscale value to a lower grayscale vale, and a direction from a lower grayscale value to a higher grayscale value.

In one embodiment of the present application, the display area comprises a plurality of the grayscales arranged in an array.

An embodiment of the present invention further provides a display panel, including the grayscales of the target grayscale area of the display panel driven by the aforementioned desired voltage for improving image quality of a picture in the target grayscale area.

An embodiment of the present invention further provides a display device, including a display panel including a display area for image displays; and a processor electrically connected to the display panel and configured to obtain a target grayscale area in the display area and to drive grayscales of the target grayscale area based on a desired voltage, wherein the desired voltage is obtained by at least two times of adjustments according to historical display data of the target grayscale area.

In one embodiment of the present application, the processor is further configured to drive the grayscales of the target grayscale area using an initial voltage to enable the target grayscale area to display a first preset image; enable the first preset image to satisfy a first predetermined requirement by adjusting the initial voltage, so that the target grayscale area display a second preset image, and obtain a driving voltage of each of the grayscales of the target grayscale area after a first adjustment process, so that a first driving voltage is obtained; and enable the second preset image to satisfy a second predetermined requirement by adjusting the first driving voltage of all the grayscales or some of the grayscales of the target grayscale area, and obtain a driving voltage of each of the grayscales of the target grayscale area after a second adjustment process; and obtain the desired voltage according to the driving voltage of each of the grayscales of the target grayscale area after the second adjustment process.

In one embodiment of the present application, the processor is further configured to obtain a plurality of second driving voltages by obtaining the driving voltage of each of the grayscales of the target grayscale area after the second adjustment process, and calculating an average value of the plurality of second driving voltages to obtain the desired voltage.

In one embodiment of the present application, the processor is further configured to capture a trailing picture in a preset video using the display panel to play the preset video prior to obtaining the target grayscale area in the display area, and to determine the target grayscale area according to the trailing picture.

In one embodiment of the present application, the processor is further configured to obtain a grayscale value of a first preset position of the trailing picture and a grayscale value of a second preset position of the trailing picture, determine a moving direction of the trailing picture transitioning to a frame following the trailing picture according to the trailing picture and the frame following the trailing picture, and determine the target grayscale area based on the moving direction, the grayscale value of the first preset position, and the grayscale value of the second preset position.

In one embodiment of the present application, the moving direction comprises a direction from a higher grayscale value to a lower grayscale vale, and a direction from a lower grayscale value to a higher grayscale value.

In one embodiment of the present application, the display area comprises a plurality of the grayscales arranged in an array.

An embodiment of the present application provides a method of controlling a display panel, and the method is used in display panels and display devices equipped with display panels, such as liquid crystal televisions, computers, etc. The display panel includes a display area configured to display images. As shown in FIG. 1, it is a first flowchart of a method of controlling a display panel in accordance with an embodiment of the present application. The method of controlling the display panel includes following steps:

Step 110: obtaining a target grayscale area in the display area.

Step 120: driving grayscales of the target grayscale area based on a desired voltage, wherein the desired voltage is obtained by at least two times of adjustments according to historical display data of the target grayscale area.

Figure 2:
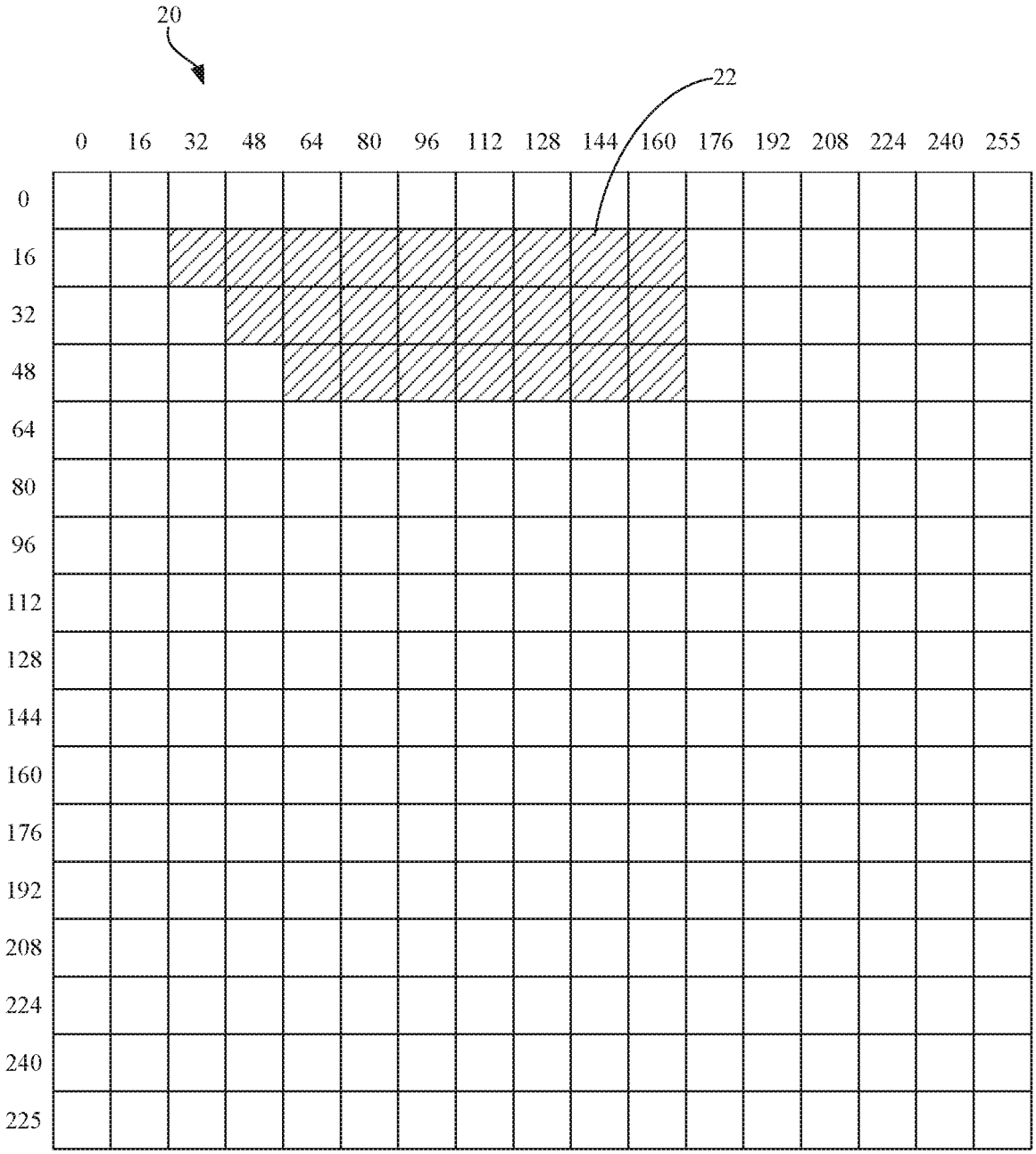
FIG. 2 is a schematic structural view of a display panel in accordance with an embodiment of the present application.

Please review FIG. 1 in combination with FIG. 2. FIG. 2 is a schematic structural view of a display panel in accordance with an embodiment of the present application. The display panel 20 may include a display area and a non-display area. The display area is configured to display images, and the non-display area is an area not for image displays. The display area may include a plurality of grayscales arranged in an array. For example, the display panel may include 255 grayscales, and a switching between grayscales is referred to as a response time. Since each of the 255 grayscales can be switched between each other, there will be 255×255 combinations of switching, which requires too many times of adjustments. Therefore, in order to reduce the number of times of adjustments, it can be set to be adjusted at an interval of 16 grayscales or eight grayscales each time. In this manner, there will be 17×17 adjustment values or 33×33 adjustment values for adjustments of the 255 grayscales. A target grayscale area, as a target grayscale area 22, in the display area is obtained. The target grayscale area 22 can be an area where a trailing dynamic picture appears. Each of the grayscales of the target grayscale area 22 is driven based on a desired voltage to increase a rotation speed of liquid crystal molecules corresponding to each of the grayscales in the target grayscale area 22, thereby improving a response time of each of the grayscales in the target grayscale area 22, so that a problem of the occurrence of the trailing dynamic picture in the target grayscale area 22 can be remedied, thereby improving display effects of the display panel 20. Specifically, the desired voltage is obtained by at least two times of adjustments according to historical display data of the target grayscale area 22. The historical display data refers to image data that has been displayed in the target grayscale area.

Figure 3:
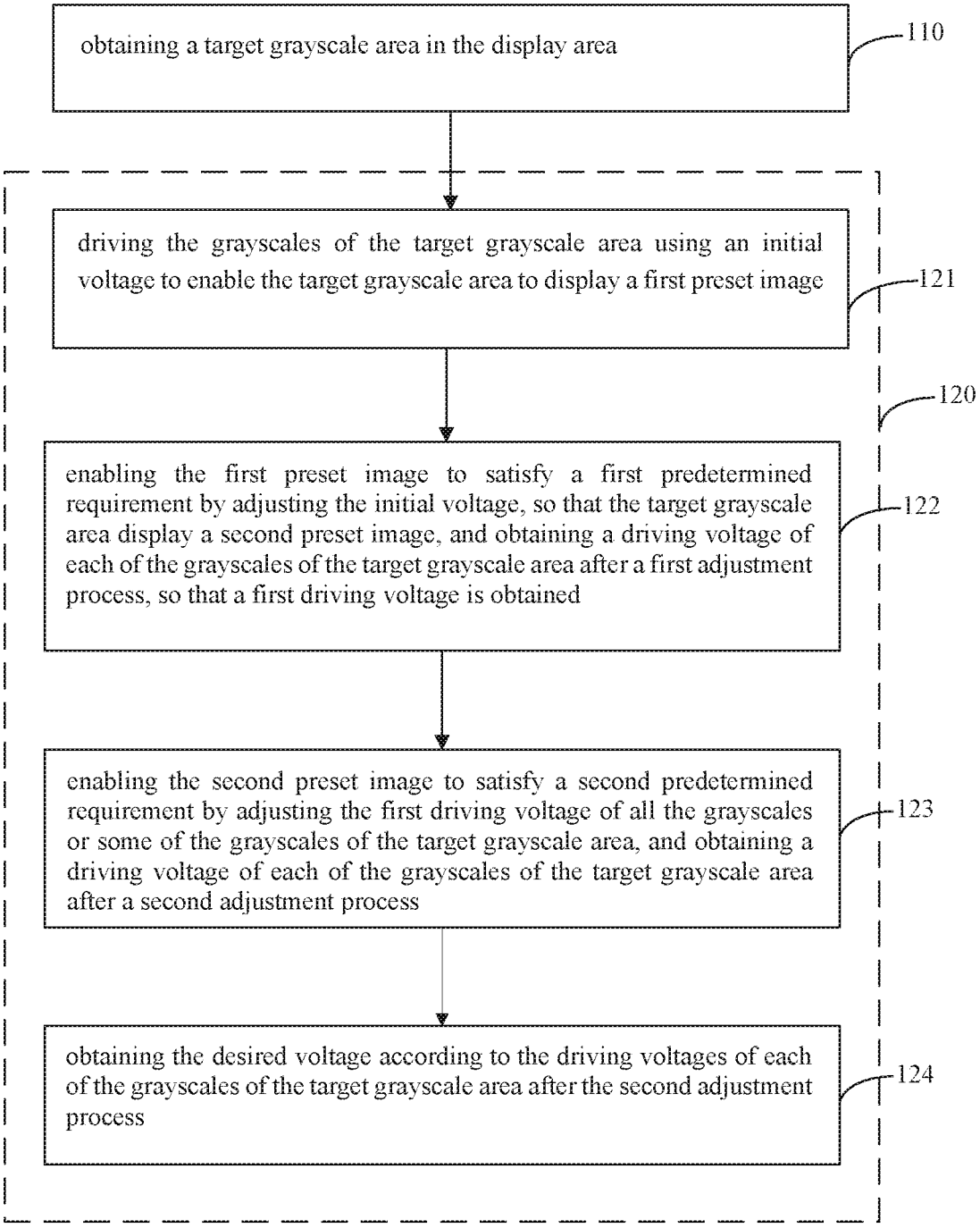
FIG. 3 is a second flowchart of a method of controlling a display panel in accordance with an embodiment of the present application.

Please further review FIG. 3. FIG. 3 is a second flowchart of a method of controlling a display panel in accordance with an embodiment of the present application. The step 120 of driving the grayscales of the target grayscale area based on the desired voltage, wherein the desired voltage is obtained by at least two times of adjustments according to the historical display data of the target grayscale area includes:

Step 121: driving the grayscales of the target grayscale area using an initial voltage to enable the target grayscale area to display a first preset image.

Step 122: enabling the first preset image to satisfy a first predetermined requirement by adjusting the initial voltage, so that the target grayscale area display a second preset image, and obtaining a driving voltage of each of the grayscales of the target grayscale area after a first adjustment process, so that a first driving voltage is obtained.

Step 123: enabling the second preset image to satisfy a second predetermined requirement by adjusting the first driving voltage of all the grayscales or some of the grayscales of the target grayscale area, and obtaining a driving voltage of each of the grayscales of the target grayscale area after a second adjustment process.

Step 124: obtaining the desired voltage according to the driving voltage of each of the grayscales of the target grayscale area after the second adjustment process.

The initial voltage is used to drive the grayscales of the display area to enable the display area to display the first preset image. The initial voltage may be adjusted over and over in the first adjustment process till the first preset image satisfies the first predetermined requirement. The predetermined requirement can be requirements set in advance, for example, such as clarity requirements. For example, the initial voltage may be adjusted till the first preset image is clearer than it is before adjustment. At this time, the display area may display an image after the first adjustment process, such as a second preset image. A driving voltage of each of the grayscales of the target grayscale area 22 after the first adjustment process is kept in a record, so that the first driving voltage is obtained. After the first adjustment process, part of the image may not meet the requirement, for example, a trailing picture may occur in part of the image. Such a problem can be solved by multiple times of adjustment to the partial image to allow the partial image to meet requirements for image quality. For example, the first driving voltage of all the grayscales or some of the grayscales of the target grayscale area 22 may be adjusted till the second preset image meet the second predetermined requirement. For example, an image displayed in the target grayscale area 22 is clearer than it is before. In addition, a driving voltage of each of the grayscales of the target grayscale area is obtained after the second adjustment process, and the desired voltage is obtained according to the driving voltage of each of the grayscales of the target grayscale area after the second adjustment process.

For example, the display area may include 17×17 adjustment values as shown in FIG. 2. Specifically, the target grayscale area 22 may include 24 grayscale adjustment values. A total of 289 grayscales are driven based on the initial voltage, so that the 289 grayscales work together for the presence of a first preset image. Specifically, the initial voltage may be a voltage set according to predetermined rules, such that the voltage may be set according to a grayscale value of each of the grayscales. Since a liquid crystal display panel is limited on performance by response times of a liquid crystal material itself, whenever grayscale values change, the liquid crystal material needs a period of response time to reach a desired grayscale value. As a result, if a voltage is set only by reference to changes of the grayscale values, the first preset image displayed in the display area cannot meet the first predetermined requirement. In order to enable the first preset image to satisfy the first predetermined requirement, an adjustment to the initial voltage is carried out till the first preset image meets the first predetermined requirement, so that the display area displays the second preset image. It should be noted that in a process of adjusting the initial voltage, initial voltages of all the grayscales of the display area such as the total of 289 grayscales can be adjusted, or initial voltages of only some of the grayscales are adjusted. For example, initial voltages of only 20 of the grayscales are adjusted, or 40 of the grayscales, or other number of the grayscales.

Specifically, voltage values of initial voltages corresponding to the 24 grayscales may be different from each other. For example, a value of an initial voltage of a grayscale A can be aV, and a value of an initial voltage of a grayscale B can be bV. Certainly, the values of the initial voltages corresponding to the 24 grayscales may be the same, or partly the same. For example, a value of an initial voltage of the grayscale A can be the same as that of the grayscale B, but different from a value of an initial voltage of a grayscale C.

After the first adjustment process, image quality of the second preset image displayed in the display area is better than that of the first preset image. However, there may still be driving voltages corresponding to grayscales of some areas that cannot meet requirements for response times, which results in occurrence of trailing dynamic pictures in partial areas. If so, a second adjustment to driving voltages in the problematic area may be needed. For example, an area including all the grayscales of the display area may be obtained as the target grayscale area 22. A first driving voltage is obtained according to a driving voltage of each of the grayscales of the target grayscale area after the first adjustment process. An adjustment to the first driving voltage of all the grayscales or some of the grayscales of the target grayscale area is carried out till the second preset image meet the second predetermined requirement. For example, an adjustment to a first driving voltage of each of the 24 grayscales, or five of the 24 grayscales, or 10 of the 24 grayscales, or other number of the grayscales is carried out till the second preset image meets the second predetermined requirement. The desired voltage is obtained according to the driving voltage of each of the grayscales of the target grayscale area 22 after the second adjustment process. In this manner, the grayscales of the target grayscale area 22 are driven based on the desired voltage, thereby improving image quality of the target grayscale area 22. It can be understood that the first adjustment process is intended for an overall adjustment of the display area, and the second adjustment process is intended for partial area of the display area. Therefore, the display effects of the display panel is improved after many adjustments and optimizations.

Figure 4:
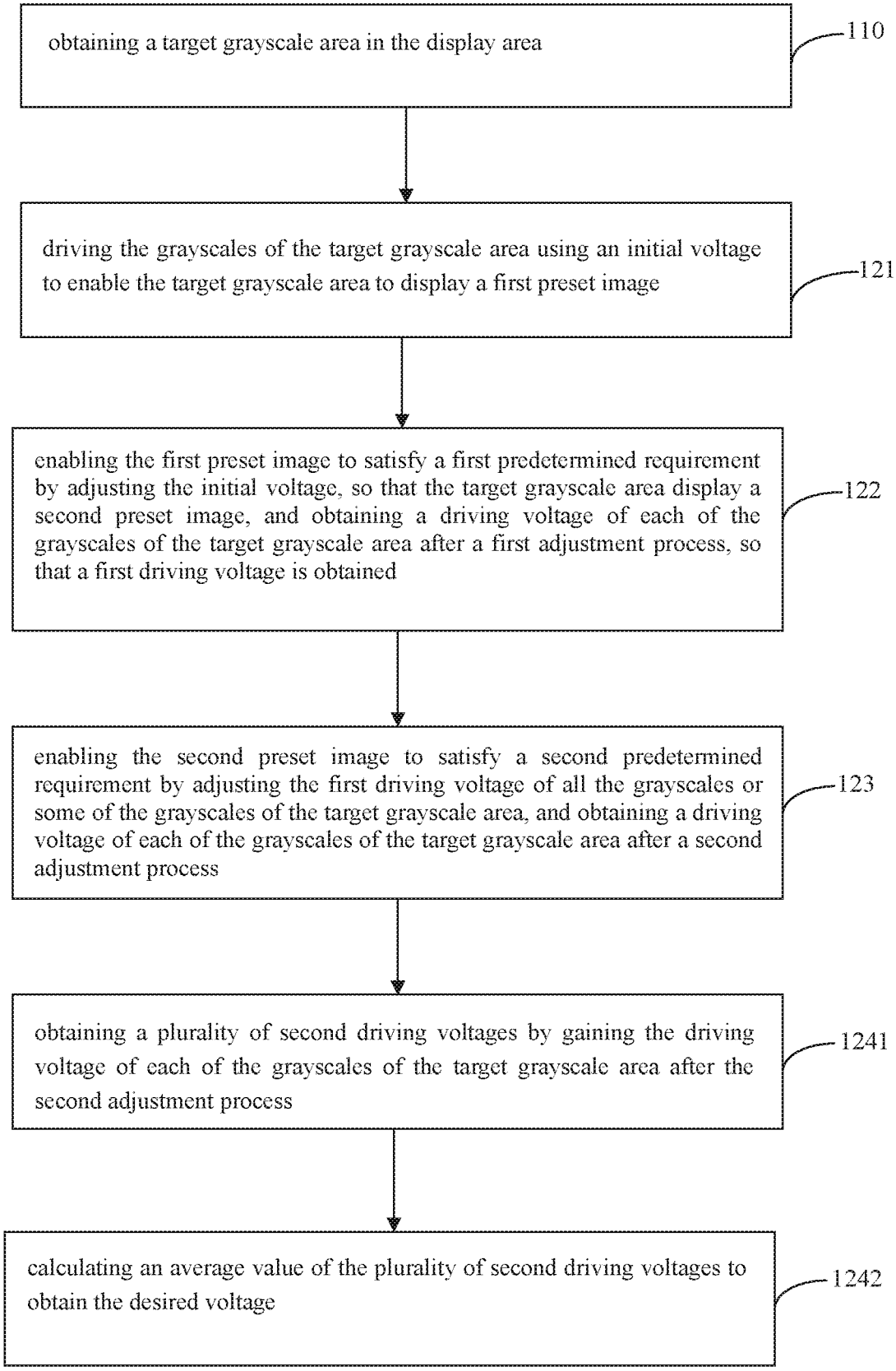
FIG. 4 is a third flowchart of a method of controlling a display panel in accordance with an embodiment of the present application.

Please refer to FIG. 4. FIG. 4 is a third flowchart of a method of controlling a display panel in accordance with an embodiment of the present application. The step 124 of obtaining the desired voltage according to the driving voltage of each of the grayscales of the target grayscale area after the second adjustment process includes:

Step 1241: obtaining a plurality of second driving voltages by gaining the driving voltage of each of the grayscales of the target grayscale area after the second adjustment process.

Step 1242: calculating an average value of the plurality of second driving voltages to obtain the desired voltage.

The driving voltage of each of the grayscales of the target grayscale area 22 after the second adjustment process can be obtained in order to gain the second driving voltages of the 24 grayscales, and the 24 second driving voltages are being calculated for acquisition of the desired voltage. For example, the 24 second driving voltages can be added and averaged to get an average value of the 24 second driving voltages, and use the average value as a desired voltage, and drive each of the grayscales of the target grayscale area based on the desired voltage. Certainly, values obtained by other calculations can also be used. For example, the desired voltage may be a median value of N number of the second driving voltages.

It should be noted that the number of optimization adjustments made in the application according to the trailing image of the target grayscale area is not limited to two, it may be three, four, or other times, etc. When the number of optimization adjustments is three times, the desired voltage is the average value of all driving voltages used in the third optimization.

It should also be noted that the driving voltage of each grayscale in the target grayscale area recorded after the second adjustment process may be used to directly drive the grayscales of the target grayscale area.

It can be understood that the grayscale brightness of the liquid crystal display device is achieved by controlling passage of light by the rotation of the liquid crystal in the liquid crystal panel. In related technologies, pre-stored over-voltage driving tables are generally used directly to drive all grayscales of display panels, without targeted optimization. Therefore, the rotation speed of liquid crystal molecules corresponding to certain areas of the display panels is too slow, and the grayscales of certain areas of the display panels are slow in responding to input signals, thereby giving rise to a problem of occurrence of trailing dynamic pictures in certain areas when the display panel is playing dynamic pictures. The present application obtains a desired voltage after at least two optimization adjustments according to historical display data of the target grayscale area 22, and uses the desired voltage to drive the grayscales of the target grayscale area 22, thereby improving the response time of the grayscales in the target grayscale area 22 to the input signal, as well as remedying the defect of occurrence of trailing dynamic pictures, and improving the display effects of the display panel 20.

This application uses the above-mentioned method of controlling the display panel to optimize three randomly selected display panels. A comparison table of average response times before and after optimization of grayscales included in target grayscale area of the three display areas is as follows:

| | First display panel | Second display panel | Third display panel |
|---|---|---|---|
| Before adjustment | 14.3 ms | 15.4 ms | 15.8 ms |
| After second adjustment | 9.2 ms | 9.2 ms | 9.6 ms |
| A difference between the average response times before and after the second adjustment | 5.1 ms | 6.3 ms | 6.2 ms |

It can be seen from the table that among the three display panels optimized by the method of controlling the display panel provided by the embodiments of the present application, the average response time of all grayscales corresponding to the target grayscale area in each of the display areas has been significantly improved. An average response time (9.3 ms) of the optimized average response time of the three display panels is reduced by 5.9 ms compared to an average response time before optimization (15.2 ms). The display effects of the optimized display panel are obvious improved.

Figure 5:
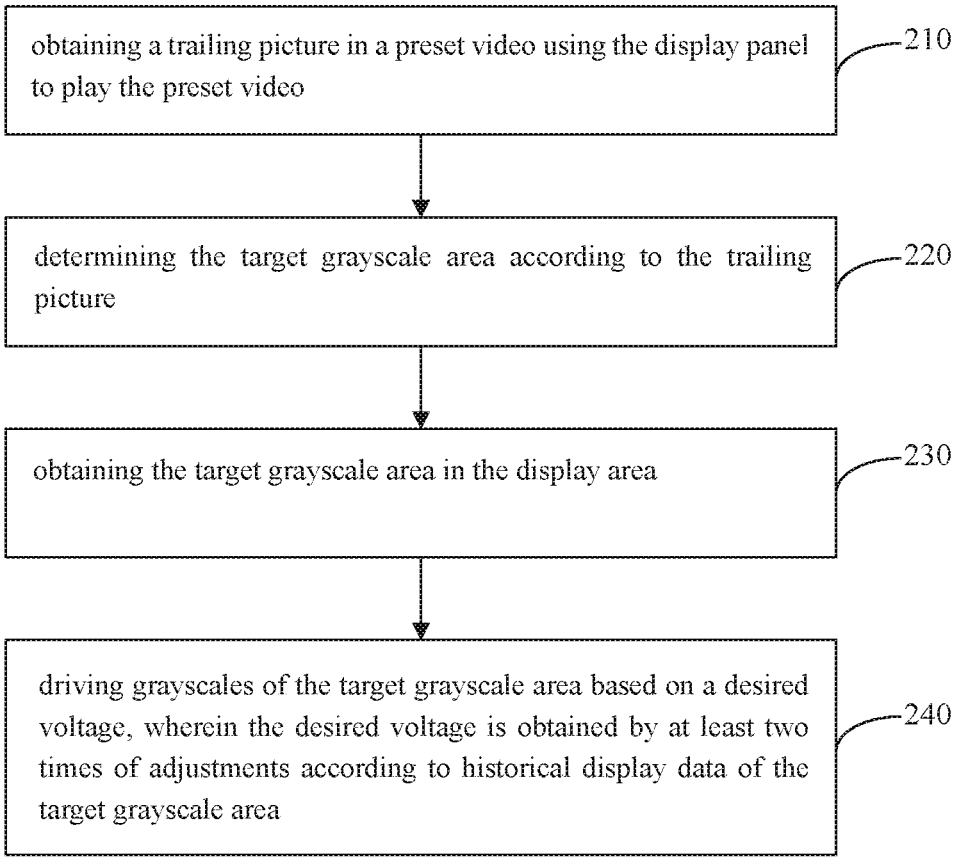
FIG. 5 is a fourth flowchart of a method of controlling a display panel in accordance with an embodiment of the present application.

As shown in FIG. 5, which is a fourth flowchart of a method of controlling a display panel in accordance with an embodiment of the present application. The controlling method includes following steps:

Step 210: using the display panel to play a preset video, and capturing a trailing picture in the preset video.

For example, a preset video may be played by the display panel 20, and the preset video may be a video selected in advance. There are dynamic pictures in the preset video, such as pictures of kicking a ball, pictures of running, and high-speed moving sports cars. The preset video can be one video, two videos, or four videos, etc., which is not limited by this application. If a trailing picture appears in the preset video played by the display panel 20, the trailing picture will be captured. For example, the video can be manually paused so that the display panel 20 can freeze the trailing picture, or software can be used to capture the trailing picture from the preset video, thereby achieving the acquisition of the trailing picture in the preset video.

Step 220: determining the target grayscale area according to the trailing picture.

The trailing picture is to be analyzed after being captured from the preset video in order to determine the target grayscale area from the trailing picture. The target grayscale area may be an area where a trailing picture occurs.

Figure 6:
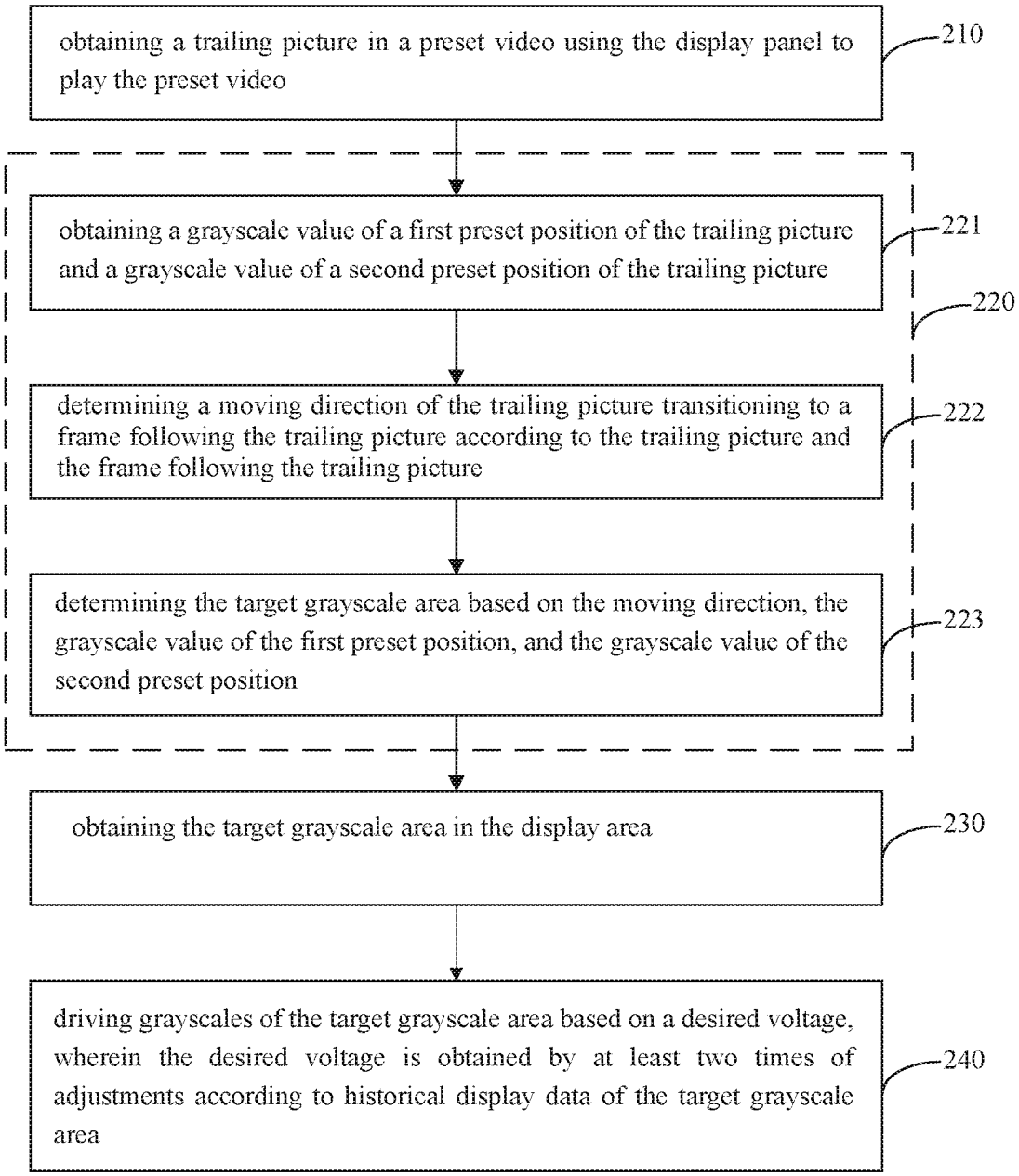
FIG. 6 is a fifth flowchart of a method of controlling a display panel in accordance with an embodiment of the present application.

Please further review FIG. 6, which is a fifth flowchart of a method of controlling a display panel in accordance with an embodiment of the present application. The step of determining the target grayscale area according to the trailing picture includes:

Step 221: obtaining a grayscale value of a first preset position of the trailing picture and a grayscale value of a second preset position of the trailing picture.

Step 222: determining a moving direction of the trailing picture transitioning to a frame following the trailing picture according to the trailing picture and the frame following the trailing picture.

Step 223: determining the target grayscale area based on the moving direction, the grayscale value of the first preset position, and the grayscale value of the second preset position.

In the embodiment of the present application, a chin of a human face with a trail is used as the trailing picture for specific description. The chin of the human face with the trail is captured, a first preset position, for example, such as grayscale values of an edge of the human face (for example, 128 grayscales), is obtained, and a second preset position is obtained, for example, such as grayscale values of a boundary area between the human face trail and a background (for example, 20 grayscales). A trail appearing after a human face image moves can be identified according to a trailing picture and a frame following the trailing picture. Specifically, the trailing picture appears to be a trail of the chin of the human face when the 128 grayscales switch to the 20 grayscales. That is, a moving direction of the trailing picture transitioning to the frame following the trailing picture is a direction from a higher grayscale value to a lower grayscale vale. An area where the trail covers can be determined according to the moving direction from a higher grayscale to a lower grayscale, the grayscale values (128 grayscales) of the first preset position, and the grayscale values (20 grayscales) of the second preset position. The target grayscale area is determined by the area where the trail covers.

It should be noted that a moving direction of a trailing picture transitioning to a frame following the trailing picture is not limited to a direction from a high grayscale to a lower grayscale, and a specific moving direction can be determined according to an actual situation of the trailing picture.

Step 230: obtaining a target grayscale area in the display area.

Step 240: driving grayscales of the target grayscale area based on a desired voltage, wherein the desired voltage is obtained by at least two times of adjustments according to historical display data of the target grayscale area.

After the target grayscale area 22 is determined according to the above-mentioned steps, the target grayscale area 22 of the display panel 20 can be obtained, and the grayscales of the target grayscale area are driven based on the desired voltage, wherein the desired voltage is obtained by at least two times of adjustments according to historical display data of the target grayscale area. For details, please refer to the steps of obtaining the desired voltage in the above-mentioned embodiment, which will not be repeated here.

In some other embodiments, different target grayscale areas may also be optimized differently. For example, when a plurality of trailing areas appears on a same trailing picture, the number of optimization adjustments can be determined according to positions of the trailing areas in the display panel. For example, if the trailing area is in a center area of the display panel, a first desired voltage can be obtained by performing m times of optimization adjustments and can be used to drive grayscales of the center area of the display panel. If the trailing area is in a corner area of the display panel, a second desired voltage can be obtained by performing n times of optimization adjustments and can be used to drive grayscales of the corner area of the display panel, wherein the number m is greater the number n, and m and n are both positive integers. Alternatively, the display panel may be divided into a plurality of areas with different priority levels in advance, and the target grayscale areas in the divided areas with the different priority levels are driven by different desired voltages.

The present application further provides a display panel such as a display panel 20. The display panel 20 is a display panel optimized by the method of controlling the display panel as mentioned above. The display panel 20 optimized by using the above-mentioned method of controlling the display panel can improve defects of trailing of dynamic pictures in related technologies, so that the display panel 20 can display dynamic pictures more clearly and improve user experience.

Figure 7:
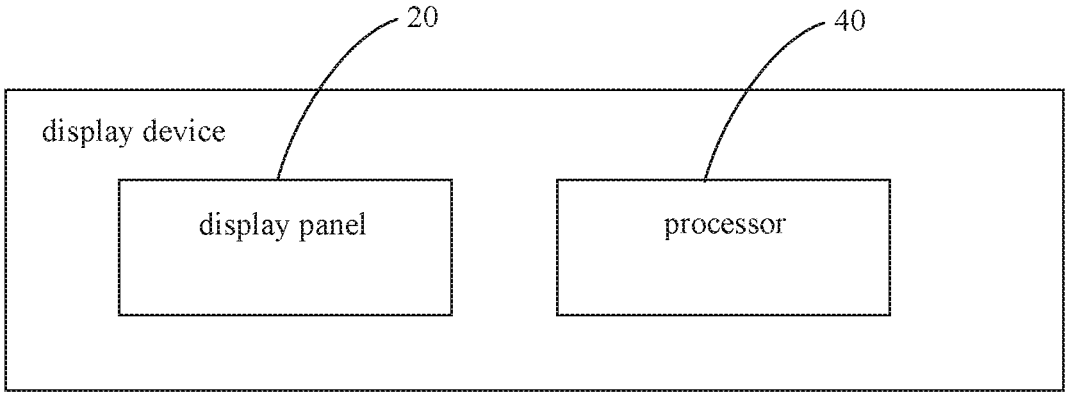
FIG. 7 is a schematic structural view of a display device in accordance with an embodiment of the present application.

As shown in FIG. 7, which is a schematic structural view of a display device provided an embodiment of the present application. The display device includes a display panel 20 and a processor 40. The display panel 20 has a target grayscale area 22, and the processor 40 is electrically connected to the display panel 20. The processor 40 is configured to obtain the target grayscale area 22 and to drive grayscales of the target grayscale area 22 based on a desired voltage, wherein the desired voltage is obtained by at least two times of adjustments according to historical display data of the target grayscale area 22.

The display panel 20 may include a display area and a non-display area. The display area is configured to display images, and the non-display area is an area not for image displays. The display area may include a plurality of grayscales arranged in an array. For example, the display panel may include 255 grayscales, and a switching between grayscales is referred to as a response time. Since each of the 255 grayscales can be switched between each other, there will be 255×255 combinations of switching, which requires too many times of adjustments. Therefore, in order to reduce the number of times of adjustments, it can be set to be adjusted at an interval of 16 grayscales or eight grayscales each time. In this manner, there will be 17×17 adjustment values or 33×33 adjustment values for adjustments of the 255 grayscales. A target grayscale area, such as a target grayscale area 22, in the display area is obtained. The target grayscale area 22 can be an area where a trailing dynamic picture appears. Each of the grayscales of the target grayscale area 22 is driven based on a desired voltage to increase a rotation speed of liquid crystal molecules corresponding to each of the grayscales in the target grayscale area 22, thereby improving a response time of each of the grayscales in the target grayscale area 22, so that a problem of the occurrence of the trailing dynamic picture in the target grayscale area 22 can be remedied, thereby improving display effects of the display panel 20. Specifically, the desired voltage is obtained by at least two times of adjustments according to historical display data of the target grayscale area 22.

The processor 40 is further configured to drive the grayscales of the target grayscale area using an initial voltage to enable the target grayscale area to display a first preset image; enable the first preset image to satisfy a first predetermined requirement by adjusting the initial voltage, so that the target grayscale area display a second preset image, and obtain a driving voltage of each of the grayscales of the target grayscale area after a first adjustment process, so that a first driving voltage is obtained; enable the second preset image to satisfy a second predetermined requirement by adjusting the first driving voltage of all the grayscales or some of the grayscales of the target grayscale area, and by obtaining a driving voltage of each of the grayscales of the target grayscale area after a second adjustment process; and obtain the desired voltage according to the driving voltage of each of the grayscales of the target grayscale area after the second adjustment process.

For example, the display area may include 289 grayscales as shown in FIG. 2, and the target grayscale area 22 may include 24 grayscales. The processor is configured to drive a total of 289 grayscales based on the initial voltage, so that the 289 grayscales work together for the presence of a first preset image. Specifically, the initial voltage may be a voltage set according to predetermined rules, such that the voltage may be set according to a grayscale value of each of the grayscales. Since a liquid crystal display panel is limited on performance by response times of a liquid crystal material itself, whenever grayscale values change, the liquid crystal material needs a period of response time to reach a desired grayscale value. As a result, if a voltage is set only by reference to changes of the grayscale values, the first preset image displayed in the display area cannot meet the first predetermined requirement. In order to enable the first preset image to satisfy the first predetermined requirement, an adjustment to the initial voltage is carried out till the first preset image meets the first predetermined requirement, so that the display area displays the second preset image. It should be noted that in a process of adjusting the initial voltage, initial voltages of all the grayscales of the display area such as the total of 289 grayscales can be adjusted, or initial voltages of only some of the grayscales are adjusted. For example, initial voltages of only 20 of the grayscales are adjusted, or 40 of the grayscales, or other number of the grayscales. Specifically, voltage values of initial voltages corresponding to the 24 grayscales may be different from each other. For example, a value of an initial voltage of a grayscale A can be aV, and a value of an initial voltage of a grayscale B can be bV. Certainly, the values of the initial voltages corresponding to the 24 grayscales may be the same, or partly the same. For example, a value of an initial voltage of the grayscale A can be the same as that of the grayscale B, but different from a value of an initial voltage of a grayscale C.

After the first adjustment process, image quality of the second preset image displayed in the display area is better than that of the first preset image. However, there may still be driving voltages corresponding to grayscales of some areas that cannot meet requirements for response times, which results in occurrence of trailing dynamic pictures in partial areas. If so, the processor 40 is further configured to perform a second adjustment to driving voltages in the problematic area. For example, the processor 40 may be further used to obtain an area including all the grayscales of the display area as the target grayscale area 22. A first driving voltage is obtained according to a driving voltage of each of the grayscales of the target grayscale area after the first adjustment process. The processor 40 is further configured to perform an adjustment to the first driving voltage of all the grayscales or some of the grayscales of the target grayscale area till the second preset image meet the second predetermined requirement. For example, an adjustment to a first driving voltage of each of the 24 grayscales, or five of the 24 grayscales, or 10 of the 24 grayscales, or other number of the grayscales is carried out till the second preset image meets the second predetermined requirement. The desired voltage is obtained according to the driving voltage of each of the grayscales of the target grayscale area 22 after the second adjustment process. In this manner, the grayscales of the target grayscale area 22 are driven based on the desired voltage, thereby improving image quality of the target grayscale area 22. It can be understood that the first adjustment process is intended for an overall adjustment of the display area, and the second adjustment process is intended for partial area of the display area. Therefore, the display effects of the display panel are improved after many adjustments and optimizations.

The processor 40 is further configured to obtain a plurality of second driving voltages by gaining the driving voltage of each of the grayscales of the target grayscale area after the second adjustment process, and calculate an average value of the plurality of second driving voltages to obtain the desired voltage.

The driving voltage of each of the grayscales of the target grayscale area 22 after the second adjustment process can be obtained in order to gain the second driving voltages of the 24 grayscales, and the 24 second driving voltages are being calculated for acquisition of the desired voltage. For example, the 24 second driving voltages can be added and averaged to get an average value of the 24 second driving voltages, and use the average value as a desired voltage, and drive each of the grayscales of the target grayscale area based on the desired voltage. Certainly, values obtained by other calculations can also be used. For example, the desired voltage may be a median value of N number of the second driving voltages.

It should be noted that the number of optimization adjustments made in the application according to the trailing image of the target grayscale area is not limited to two, it may be three, four, or other times, etc. When the number of optimization adjustments is three times, the desired voltage is the average value of all driving voltages used in the third optimization.

It should also be noted that the driving voltage of each grayscale in the target grayscale area recorded after the second adjustment process may be used to directly drive the grayscales of the target grayscale area.

It can be understood that the grayscale brightness of the liquid crystal display device is achieved by controlling passage of light by the rotation of the liquid crystal in the liquid crystal panel. In related technologies, pre-stored over-voltage driving tables are generally used directly to drive all grayscales of display panels, without targeted optimization. Therefore, the rotation speed of liquid crystal molecules corresponding to certain areas of the display panels is too slow, and the grayscales of certain areas of the display panels are slow in responding to input signals, thereby giving rise to a problem of occurrence of trailing dynamic pictures in certain areas when the display panel is playing dynamic pictures. The processor 40 of the present application obtains a desired voltage after at least two optimization adjustments according to historical display data of the target grayscale area 22, and uses the desired voltage to drive the grayscales of the target grayscale area 22, thereby improving the response time of the grayscales in the target grayscale area 22 to the input signal, as well as remedying the defect of occurrence of trailing dynamic pictures, and improving the display effects of the display panel 20. The processor 40 is further configured to capture a trailing picture in a preset video using the display panel to play the preset video prior to obtaining the target grayscale area in the display area, and to determine the target grayscale area according to the trailing picture.

For example, a preset video may be played by the display panel 20, and the preset video may be a video selected in advance. There are dynamic pictures in the preset video, such as pictures of kicking a ball, pictures of running, and high-speed moving sports cars. The preset video can be one video, two videos, or four videos, etc., which is not limited by this application. If a trailing picture appears in the preset video played by the display panel 20, the trailing picture will be captured. For example, the processor 40 is configured to control software to capture the trailing picture from the preset video, thereby achieving the acquisition of the trailing picture in the preset video.

After being captured from the preset video, the trailing picture is analyzed by the processor 40 in order to determine the target grayscale area 22 from the trailing picture. The target grayscale area 22 may be an area where a trailing picture occurs.

The processor 40 is further configured to obtain a grayscale value of a first preset position of the trailing picture and a grayscale value of a second preset position of the trailing picture; determine a moving direction of the trailing picture transitioning to a frame following the trailing picture according to the trailing picture and the frame following the trailing picture; and determine the target grayscale area based on the moving direction, the grayscale value of the first preset position, and the grayscale value of the second preset position.

For example, the processor 40 can obtain a grayscale value of a first preset position of a trailing picture and a grayscale value of a second preset position of a trailing picture, respectively, and determine a moving direction of the trailing picture transitioning to a frame following the trailing picture according to the trailing picture and the frame following the trailing picture, and finally determine the target grayscale area based on the moving direction, the grayscale value of the first preset position, and the grayscale value of the second preset position. It should be noted that the moving direction of the trailing picture transitioning to the frame following the trailing picture is not limited to the direction from a high grayscale to a lower grayscale.

In some other embodiments, the processor 40 may not be integrated in the display device. For example, the processor 40 may be integrated in a debugging device, and the debugging device is used to adjust and optimize the display device.

The method of controlling the display panel, the display panel, and the display device provided by the embodiments of the present invention are described in detail above. Specific embodiments are used in this article to illustrate the principles and implementation of the application. The description of the above embodiments is only used to help understand the application. Also, those of ordinary skill in the art should understand that they can still modify the technical solutions described in the foregoing embodiments. Accordingly, the content of the application should not be construed as a limitation on this application.

What is claimed is:

1. A method of controlling a display panel, the display panel comprising a display area for image displays, and the method comprising:

obtaining a target grayscale area in the display area;

driving grayscales of the target grayscale area based on a desired voltage, comprising:

driving the grayscales of the target grayscale area using an initial voltage to enable the target grayscale area to display a first preset image, wherein the initial voltage is a voltage set according to predetermined rules;

enabling the first preset image to satisfy a first predetermined requirement by adjusting the initial voltage, so that the target grayscale area display a second preset image, and obtaining a driving voltage of each of the grayscales of the target grayscale area after a first adjustment process, so that a first driving voltage different from the initial voltage is obtained;

enabling the second preset image to satisfy a second predetermined requirement by adjusting the first driving voltage of all the grayscales or some of the grayscales of the target grayscale area, and obtaining a driving voltage of each of the grayscales of the target grayscale area after a second adjustment process; and obtaining a desired voltage according to the driving voltage of each of the grayscales of the target grayscale area after the second adjustment process;

wherein the desired voltage is obtained by at least two times of adjustments according to historical display data of the target grayscale area.

2. The method of controlling the display panel of claim 1, wherein the obtaining the desired voltage according to the driving voltage of each of the grayscales of the target grayscale area after the second adjustment process comprises:

obtaining a plurality of second driving voltages by gaining the driving voltage of each of the grayscales of the target grayscale area after the second adjustment process; and calculating an average value of the plurality of second driving voltages to obtain the desired voltage.

3. The method of controlling the display panel of claim 1, wherein prior to the obtaining the target grayscale area in the display area, the method further comprises:

using the display panel to play a preset video, and capturing a trailing picture in the preset video; and determining the target grayscale area according to the trailing picture.

4. The method of controlling the display panel of claim 3, wherein the determining the target grayscale area according to the trailing picture comprises:

obtaining a grayscale value of a first preset position of the trailing picture and a grayscale value of a second preset position of the trailing picture;

determining a moving direction of the trailing picture transitioning to a frame following the trailing picture according to the trailing picture and the frame following the trailing picture; and determining the target grayscale area based on the moving direction, the grayscale value of the first preset position, and the grayscale value of the second preset position.

5. The method of controlling the display panel of claim 4, wherein the moving direction comprises a direction from a higher grayscale value to a lower grayscale vale, and a direction from a lower grayscale value to a higher grayscale value.

6. The method of controlling the display panel of claim 1, wherein the display area comprises a plurality of the grayscales arranged in an array.

7. A display panel, comprising the grayscales of the target grayscale area of the display panel driven by the desired voltage of claim 1 for improving image quality of a picture in the target grayscale area.

8. A display device, comprising:

a display panel comprising a display area for image displays; and a processor electrically connected to the display panel;

wherein the processor is configured to perform acts comprising:

obtaining a target grayscale area in the display area;

driving grayscales of the target grayscale area, and using an initial voltage set according to predetermined rules to enable the target grayscale area to display a first preset image;

enabling the first preset image to satisfy a first predetermined requirement by adjusting the initial voltage, so that the target grayscale area display a second preset image;

obtaining a driving voltage of each of the grayscales of the target grayscale area after a first adjustment process, so that a first driving voltage different from the initial voltage is obtained;

enabling the second preset image to satisfy a second predetermined requirement by adjusting the first driving voltage of all the grayscales or some of the grayscales of the target grayscale area;

obtaining a driving voltage of each of the grayscales of the target grayscale area after a second adjustment process; and obtaining a desired voltage according to the driving voltage of each of the grayscales of the target grayscale area after the second adjustment process;

wherein the desired voltage is obtained by at least two times of adjustments according to historical display data of the target grayscale area.

9. The display device of claim 8, wherein the processor is further configured to obtain a plurality of second driving voltages by obtaining the driving voltage of each of the grayscales of the target grayscale area after the second adjustment process, and calculating an average value of the plurality of second driving voltages to obtain the desired voltage.

10. The display device of claim 9, wherein the processor is further configured to capture a trailing picture in a preset video using the display panel to play the preset video prior to obtaining the target grayscale area in the display area, and to determine the target grayscale area according to the trailing picture.

11. The display device of claim 10, wherein the processor is further configured to obtain a grayscale value of a first preset position of the trailing picture and a grayscale value of a second preset position of the trailing picture, determine a moving direction of the trailing picture transitioning to a frame following the trailing picture according to the trailing picture and the frame following the trailing picture, and determine the target grayscale area based on the moving direction, the grayscale value of the first preset position, and the grayscale value of the second preset position.

12. The display device of claim 11, wherein the moving direction comprises a direction from a higher grayscale value to a lower grayscale value, and a direction from a lower grayscale value to a higher grayscale value.

13. The display device of claim 8, wherein the display area comprises a plurality of the grayscales arranged in an array.

* * * * *